United States Patent [19]

Coester

[11] Patent Number: 4,658,732

[45] Date of Patent: Apr. 21, 1987

[54] PNEUMATIC PROPULSION SYSTEM FOR FREIGHT AND/OR PASSENGER VEHICLES

[76] Inventor: Oskar H. W. Coester, Rua David Francisco Mauricio 85, Porto Alegre, Rio Grande do Sul, Brazil

[21] Appl. No.: 596,434

[22] Filed: Apr. 3, 1984

[30] Foreign Application Priority Data

Apr. 4, 1983 [BR] Brazil ..... PI 8301706

[51] Int. Cl.[4] ..... B61B 13/12

[52] U.S. Cl. ..... 104/156; 104/161

[58] Field of Search ..... 104/155, 156, 161, 23 FS, 104/245, 288; 105/343, 348; 137/527.8

[56] References Cited

U.S. PATENT DOCUMENTS

| | | | |
|---|---|---|---|
| 44,376 | 9/1864 | Alison et al. | 104/155 |
| 244,524 | 7/1881 | Bardwell et al. | 104/155 |
| 384,054 | 6/1888 | Mayall | 104/161 |
| 409,769 | 8/1889 | Bodefeld | 104/161 |
| 502,539 | 8/1893 | Von Siemens | 104/288 |
| 900,407 | 10/1908 | Mende | 105/348 |
| 942,265 | 12/1909 | Kling | 105/343 |
| 3,233,556 | 2/1966 | McDonald | 104/161 X |
| 3,565,011 | 2/1971 | Edwards | 104/156 X |
| 3,610,163 | 10/1971 | Edwards | 104/156 |
| 3,722,424 | 3/1973 | Van Veldhuizen | 104/23 FS |
| 3,941,151 | 3/1976 | Biddle | 137/527.8 X |
| 3,999,487 | 12/1976 | Valverde | 104/155 X |
| 4,108,079 | 8/1978 | Carstens et al. | 104/156 X |
| 4,216,725 | 8/1980 | Hallam | 105/348 |
| 4,252,285 | 2/1981 | Hammond et al. | 104/161 X |
| 4,307,750 | 12/1981 | Ledeen | 137/487.5 |
| 4,419,924 | 12/1983 | Peter et al. | 188/170 X |
| 4,429,771 | 2/1984 | Martin | 188/170 |
| 4,431,020 | 2/1984 | Kowalski | 137/487.5 X |

FOREIGN PATENT DOCUMENTS

| | | | |
|---|---|---|---|
| 0833262 | 2/1970 | Canada | 104/155 |
| 2822806 | 11/1978 | Fed. Rep. of Germany | 104/156 |
| 0010079 | 12/1834 | France | 104/156 |
| 0010981 | of 1845 | United Kingdom | 104/155 X |
| 0000598 | of 1865 | United Kingdom | 104/156 |

*Primary Examiner*—Robert B. Reeves
*Assistant Examiner*—Scott H. Werny
*Attorney, Agent, or Firm*—Ostrolenk, Faber, Gerb & Soffen

[57] ABSTRACT

A pneumatic propulsion system for passenger vehicles is constituted by a structural beam, composed of modular elements end-supported on pillars. The beam supports the trackway and provides an air duct for pneumatic propulsion of vehicles. A longitudinal slit in the top surface of the beam is sealed by flexible flaps and that press against each other to seal off the duct, while allowing for the passage of support mast. Airflow for propulsion of the vehicle is generated by a stationary airflow generator, which feeds the air propulsion duct by way of connecting ducts and which is outfitted with a set of four butterfly control valves that are controlled by a command and control system of flow and pressure condition in the duct which actuates the valves pneumatically, allowing automatic or manual selection of "suction" or "pressure" conditions in the duct. Shutoff valves are fitted to openings in the bottom surface of the beam to allow isolation of segments of the propulsion air duct or, alternatively, its venting to connecting ducts or to the atmosphere, allowing by means of a combination of several valves to delimit a specific propulsion air circuit. Traction of the vehicles results from the difference in pressure that is established on opposite sides of propulsion plate by the effect of the airflow generated by the generator unit. A support mast connects to a propulsion plate jointly with a traction arm which transfers the resultant tractive force to the vehicle. Adjustable decompression panels assembled on the propulsion plate assure that a maximum safe pressure differential limit is not exceeded, said limit being controlled by the action of a set of springs positioned on both sides of the propulsion plate.

19 Claims, 22 Drawing Figures

| | OPERATIONS | |
|---|---|---|
| VALVE | SUCTION | PRESSURE |
| A | CLOSED | OPEN |
| B | OPEN | CLOSED |
| C | CLOSED | OPEN |
| D | OPEN | CLOSED |

PNEUMATIC PROPULSION SYSTEM FOR FREIGHT AND/OR PASSENGER VEHICLES

BACKGROUND OF THE INVENTION

The present invention deals with the improvements introduced in a pneumatic propulsion system for freight and/or passenger vehicles, which aim to enhance its constructive and functional features, ensuring this system a highly favorable performance in the transportation of freight and/or passengers.

The state-of-the-art, taken as reference for the insertion of the improvements described in this report, is represented by the pneumatic propulsion system for freight and/or passenger vehicles according to the Brazil Patent of Invention nbr. 7703372 deposited on the 25 th of May of 1977 characterized by comprising a tube having a longitudinal slit with a sealing system, a pylon, attaching a propelling fin assembly that travels in the tube to the frame of a vehicle that is supported by the tube, said pylon sliding through the longitudinal slit, propulsion being effected by means of a high-speed airflow acting on the blocking surface of the propelling fin moving it and consequently setting the vehicle into motion on devices adequate to support such motion, said airflow being generated by stationary air sources positioned outside the vehicle. Said system vehicle is provided with brakes that act directly on the motion-support devices and its tube is outfitted with conduits for telephone lines. The pneumatic system so described is characterized by pneumatic propulsion of vehicles from stationary units, and the system objectives are as follows: to provide an urban transportation system dimensioned to cater for today's and future needs; to make compatible under one unique concept optimum features for vehicles, trackway and terminals, to achieve significant advances in economics, speed, regularity, comfort and safety at low cost.

Also known as state-of-the-art are first improvements introduced in the pneumatic transportation system for freight or passenger vehicles in accordance with the Brazil Patent of Invention nbr. 7906255 deposited on the 28th of Sept. of 1979, characterized by having a propulsion duct which besides channelling air for vehicle propulsion additionally provides the structure required to install an elevated trackway, that is, the structure of the propulsion duct itself embodies an elevated trackway with integrally attached rails, thereby doing away with any other rail support structures, except for structures spaced at intervals wide enough so not as to interface with surface traffic that support or hold the entire structure above ground. A part of said system provisions are made to seal the longitudinal slit in the duct, when suction is applied to the duct, said differential pressure acting on a flexible seal and pressing it against a stop, allowing at same time passage of the propulsion pylon by mechanical displacement of the elastic flap, said elastic flap also allowing for sealing in overpressure, a pressure relief system also being provided. Said system incorporates a flow alternator close to each air blower unit which, in combination with a flow control valve provides control over any airflow condition in the duct, thus determining vehicle movements by remote control. Said system comprises a set of valves at each terminal arranged to ensure means of control for a safety system that guarantees positive separation of vehicles under any circumstances, overall system being under control of one operator and/or an automatic control system located at each station. The perfected automatic propulsion system for transportation of cargo and/or passengers as described above and which is characterized by pneumatic propulsion of vehicles from stationary airflow generating units, has the following basic objectives:

1. Provide an elevated trackway for transportation vehicle traffic, said way having least possible dimensions for a given transport capacity, aiming at low building and installation costs, and minimum environmental impact.

2. To achieve extremely light and simple transportation vehicles, free of any propulsion equipments, the low weight of which will require little energy for accelerating and braking and impose a low stress level to the trackway, aiming also at simple construction and maintenance, low operating costs and high reliability.

3. Provide a vehicle propulsion system that is stationary, aiming at low vehicle weight, low maintenance costs, high reliability, minimum environmental pollution.

4. Provide a pneumatic propulsion system that does not engage vehicular wheels, effecting vehicle traction by means of a device that is independent of the wheels, with the objective of overcoming the limitations imposed by wheel/rail systems on the performance of rail transport vehicles. And, lastly, 5. To effect the integration of all elements in a freight and/or passenger transportation system on an elevated way, silent, non-pollutant, adequate for installation over streets of urban centers, with low investment, low operating costs, high reliability and safety and high transport capacity.

SUMMARY OF THE INVENTION

The present invention refers to a series of improvements introduced in a pneumatic propulsion system for cargo and/or passenger vehicles, characterized basically by having a propulsion duct that, besides channelling air for vehicle propulsion provides the structure necessary to install an elevated trackway transportation system, that is, the structure of the propulsion duct itself embodies an elevated trackway with integrally attached rails, thereby doing away with any other rail support structures, except for structures spaced at intervals wide enough so as not to interfere with surface traffic, that support or hold the entire structure above ground. The invention, object of the present descriptive report deals, firstly, with a specific constructive form for the propulsion duct structure, characterized basically by pre-formed concrete or steel structural elements which, once assembled form end-supported beams of great strength and lightness to support the system trackway said beams functioning at the same time as air propulsion ducts and embodying structural provisions for installation of air flow control valves and/or secondary air ducts. Upon system installation the trackway is installed by first erecting support pillars at regular spacing, on which the ends of the modular beams are then laid and aligned, that constitute the support base for the rails. Sealing at beam butt ends forms the air duct for system propulsion. Modular construction of beams and pillars ensures pre-fabrication of all elements of the trackway of this transportation system in a plant and/or a remote building site, with quick erection on-site, incurring in minimal traffic disruption.

Another important feature of this invention is the improved device to seal the longitudinal slit in the propulsion air duct, the objective of said seal being to contain the air differential pressure between the duct interior and the atmosphere as generated by airflow generator units, while providing passage to the propulsion plate attaching mast with minimum losses. Said device consists basically of two flexible flaps attached to opposite faces of the duct slit, which are superimposed, allowing for passage of the attaching mast or pylon by mechanical displacement of the flexible flaps, while at the same time a pressure differential, either positive or negative, between air duct and the atmosphere will press the seal flaps tightly against each other, providing for efficient duct sealing. In the pneumatic propulsion system dealt with in the present invention, the vehicle is controlled by regulating the airflow in the propulsion air duct by use of butterfly control valves associated with our airflow generator unit, which, by their position, determine the direction, speed and differential pressure of airflow in the duct within the full performance range of pressure and flow of that air generator unit. A set of four valves located at each air unit and interconnecting its suction and discharge ports to the propulsion air duct and the atmosphere provided, by means of a combined operation, the desired airflow control with high reliability and safety.

The airflow regulation system by means of control valves presented in this invention has its actuation effected by pneumatic cylinders, which may take up several positions and are electrically controlled. By use of electronic logic circuits their command is effected throughout the position combinations required for vehicle operation in its full performance range in both directions, command being exerted by the operator from a remote position close or away from a passenger terminal, by means of a single electric selector switch, or, in case of automatic system operation, said logic circuits instead of being controlled manually will be controlled electrically by an interface module with a control microprocessor.

This invention also presents a design for duct shutoff valves that are installed to the propulsion duct with the function of interrupting airflow at that point, whenever required in order to, in combination with similar valves, delimit a specific propulsion air circuit, said shutoff valve being of simple design while providing reliable and safe operation.

The present invention also provides a means to determine position and speed of the vehicle, while the same travels over the trackway, giving the operator at his operation stand continuous information about these parameters and, if required, feeding information to a control microprocessor. For this purpose, the trackway is outfitted at regular intervals with "reed" electromagnetic sensors or other electromagnetic detection devices, all connected to a control unit located at the operator's station, which control unit has the function of intergrating the electric impulses received from these devices. The front and rear axle of the vehicle are equipped with permanent magnets or devices with similar magnetic effect, that are aligned in the longitudinal plane with the above-mentioned electromagnetic sensors. At passage of the first magnet over a specific magnetic switch said switch closes instantly sending an electric impulse to the central unit that will signal vehicle position. Time elapsed between passage of first and second magnets is computed by the central unit to provide vehicle speed at the moment of its passage over that sensor.

In a conventional application the airflow generator unit for pneumatic propulsion of the vehicle consists in a stationary centrifugal air blower driven by an electric motor. In the present invention a simple method is described to provide a two-speed drive for this blower. It consists in coupling together the propulsion shafts of two electric motors having different rotations, for instance four- and six-pole motors, the two motors becoming linked in series. The assembly is coupled to the air blower. Thus, by energizing one or the other of the electric motors different rotations are selected for operation of the air blower. Since the performance curves of the blower are a function of the rotation, it is possible by this way to select the pressure/flow curve that is more adequate for a specific vehicle performance. For instance, applying higher rotation in the acceleration phase a greater pressure differential is achieved, providing a larger thrust for acceleration of the vehicle. For the constant speed and deceleration phases, a lower-rotation motor may be applied, as a way of reducing the specific energy consumption of these phases. The described arrangement also holds the advantage of motor redundancy, since, in case of failure of one motor, the other will take over, driving the air blower.

Concerning the vehicle, the present invention presents an important improvement for operational safety which is applicable to any vehicle on elevated trackways. Such vehicles must be protected against derailments, caused, for instance, by operating at excessive speed, by effect of high winds or by debris on the rails. The traditional solution for this problem consists adding weight to the vehicle, at the same time lowering its center of gravity as much as possible. In the present invention, the beam that supports the trackway is hollow and is fitted with a longitudinal slit on its upper plane, thus allowing for the installation of retainer wheels that, travelling close to the inner face of the upper beam plane, are connected to the vehicle by a support mast or pylon that passes through the slit. The retainer wheels limit excess vertical movement of the vehicle's wheels to less than wheel retention height on the rail, thus ensuring total safety against derailings. This improvement is applicable to any transportation vehicle on rails, over an elevated trackway, and in the specific case of pneumatically driven vehicles according to the present invention, the mentioned retainer wheels may be associated with the propulsion plate structure. By this way, the assembly propulsion plate-support mast besides performing as the vehicle's traction element also function as the anti-derailing device.

Concerning the vehicle's propulsion plate, this invention presents an improvement of the attachment of the plate to the vehicle, in which the support mast is attached to a main crossbeam of the vehicle's structure by means of a pin, torsion being taken up directly by the vehicle structure by means of a traction bar and swivel joint.

The support mast is positioned behind the propulsion plate, to reduce pressure losses and the mechanical loads at passage through the flexible propulsion duct seal.

Another improvement of the propulsion plate that is presented by this invention, consists in the presence of decompression panels in the propulsion plate structure. The panels have adjustable opening pressure and their purpose is to protect the system's structure against differential pressure peaks in the air duct in excess of a safety level. If, for any reason, the pressure differential between the inside of the duct and the atmosphere reaches the limit, either positive or negative, the decompression panels will move, relieving pressure by equalization of pressure on both sides of the plate, thus protecting the structure of the air duct and/or the propulsion plate itself against excessive pressure differentials.

This invention presents an improvement in the design of the vehicle's wheels. The tread of the wheel is a steel rim, adequately profiled to roll on rails. This rim is tied to the wheel hub exclusively by a layer of rubber of high hardness. In this way, rolling vibrations are dampened, avoiding their transmission to the wheel hub and the vehicle's structure, ensuring a silent and vibration-free ride. Another improvement of the vehicle of the pneumatic propulsion system dealt with in this invention consists in dual independent bogeys. Each bogey is composed of two wheels assembled in one longitudinal plane on axles located at the two ends of a beam which at its center connects with a main crossbeam of the vehicle through a thrust bearing. In conjunction with the symmetrical unit on the other rail, it makes up a wheel system characterized by having four free-spinning wheels independent from each other. On the other hand, the vehicle body is supported on the crossbeams by pneumatic cushions, to dampen vibrations.

An important improvement is introduced in the vehicle's brake system by this invention, consisting in a differential pressure sensor that actuates the brakes whenever the air pressure differential acting on the propulsion plate drops to values close to zero. The sensor is made up by a bellows-type chamber divided in two compartments by a diaphragm. Each compartment is connected to a pressure probe on one side of the propulsion plate. The diaphragm displaces itself from its central position under the effect of the pressure differential between the two sides of the propulsion plate and actuates microswitches that close the electric circuits that will release the brakes. In its central position, signifying lack of differential, the open microswitches will actuate the pneumatic brake actuation system. Considering the zero-pressure differential state means that there is no traction generated by the propulsion plate for the vehicle, it becomes apparent that the brakes will be actuated anytime there is energy loss for the system. Alternatively the pneumatic brake actuation system may be activated manually by an electric switch inside the vehicle.

As concerns vehicle doors, the improvements put forward by this invention consist in lateral double doors that slide along the vehicle's external surface, both sides of each door being actuated by a pneumatic cylinder lodged under the vehicle's floor and interconnected by flex cables on pulleys, to syncronize their movement. Air pressure for the pneumatic cylinders is obtained from a dual electro pneumatic air system fed by on-board batteries.

The system's electro pneumatic valves are controlled by the door control electronic module which adjusts opening time, provides audio warning of door closure and closes the doors, also having door system interlocks, and other functions. On the other hand, frontal windows at both ends of the vehicle allow full opening to provide emergency exit to passengers.

Concerning the vehicle's electric system, the invention presents a method to furnish electrical power to the vehicle from a stationary power supply by rail electrification in with low-tension, alternating current, around 50 volts. Rails are laid on non-conducting mats and can, therefore, be used for this purpose.

A graphite collector brush system on the vehicle's wheel assemblies collects and transmits electrical current into the vehicle, where a transformer-rectifier system conserts to continuous current compatible with the on-board batteries. All electrical demands of the vehicle, such as lighting, sound, energy for the control circuits, and air compressors are met by the batteries, which, in turn, are charged by the supply system above described. For added safety, all described systems are duplicated.

DESCRIPTION OF THE PREFERRED EMBODIMENT

Figure 1:
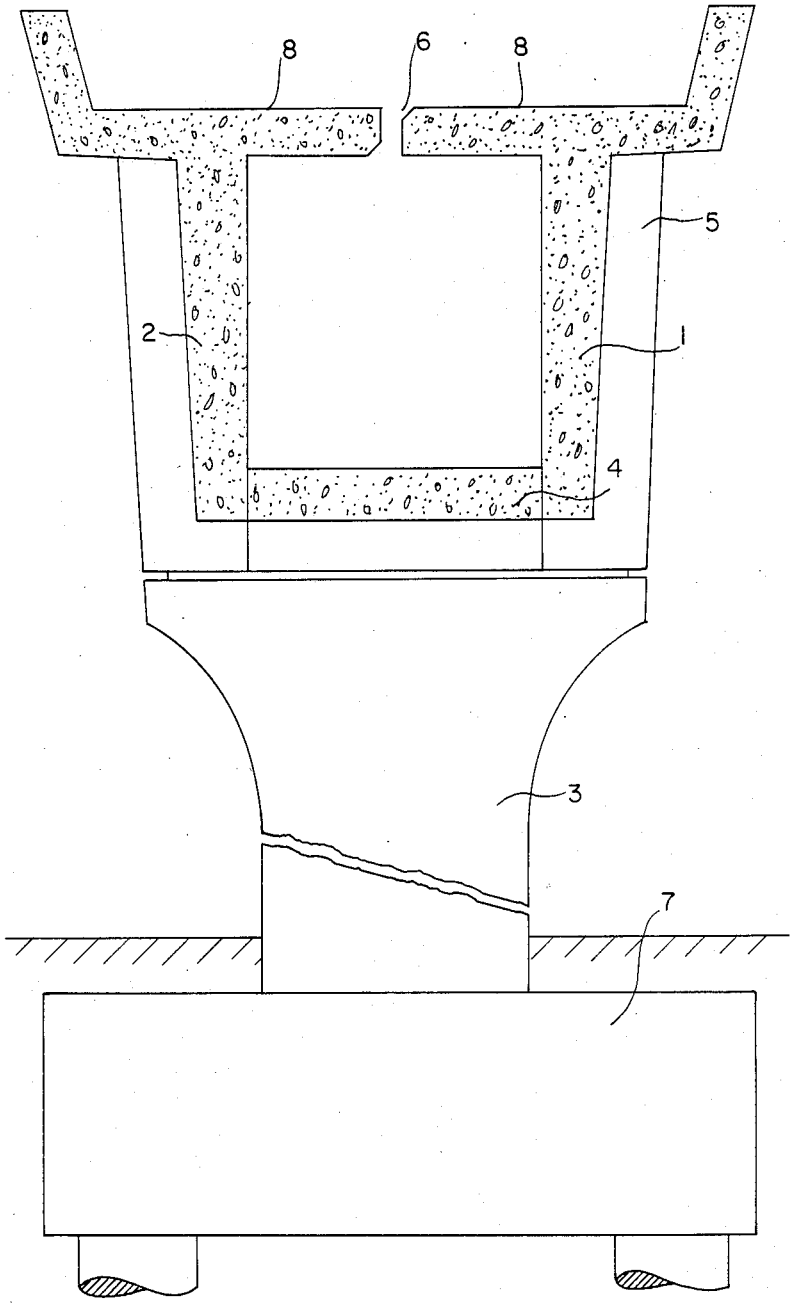
FIG. 1 is a transverse cross-section through a trackway supporting and air channeling beam of a transportation system constructed in accordance with teachings of the instant invention.

Reference is made to the enclosed Drawings, that are a part of this descriptive report. FIG. 1 shows a cross-section of a beam having the dual function of providing support for the transportation system trackway and channeling air for pneumatic propulsion of the vehicles. Modules (1) and (2) are precast concrete or steel elements which, when symmetrically laid on pillar (3) together with bottom module (4), also precast in concrete or pre-fabricated in steel make up the mentioned beam. As an assembly, modules (1) (2) and (4) provide the function of a structural beam for support of the transportation system trackway, while its inner volume functions as an air duct for pneumatic propulsion of vehicles. For this purpose the interior of the beam has a constant cross section and is wholly sealed off except on the top surface where a longitudinal slit (6) provides passage to the structural member that connects the propulsion plate that travels inside the beam with the vehicle that travels on rails assembled to the upper surface of the beam.

Modules (1) (2) and (4) may be pre-cast or fabricated in one piece if convenient. In either case, the structure of the lateral modules (1) and (2) is designed to withstand the stresses acting on the assembly, allowing openings to be made in the bottom module (4) for installation of valves or secondary air ducts. The importance of hoops (5) lies in maintaining the rigidity of the top horizontal member (8) of modules (1) and (2) when the assembly is subjected to differential air pressures, avoiding dimensional changes in the width of longitudinal slit (6) which provides passage to the support mast of the vehicle's propulsion plate. Pillar (3) also is a pre-cast or fabricated element that is set on foundation block (7).

The figure shown characterizes a beam that is assembled from modular elements (1) (2) and (4) and is supported on pillars (3) that are erected on foundation blocks (7). The beam has provisions for openings in bottom module (4) for installation of valves or secondary ducts, a longitudinal slit (6) that provides passage to the support mast of the propulsion plate, and reinforcing hoops (5) at both ends. The assembly provides the function of a structural beam for support of the vehicle trackway together with the function of air duct for pneumatic propulsion of vehicles.

Figure 1A:
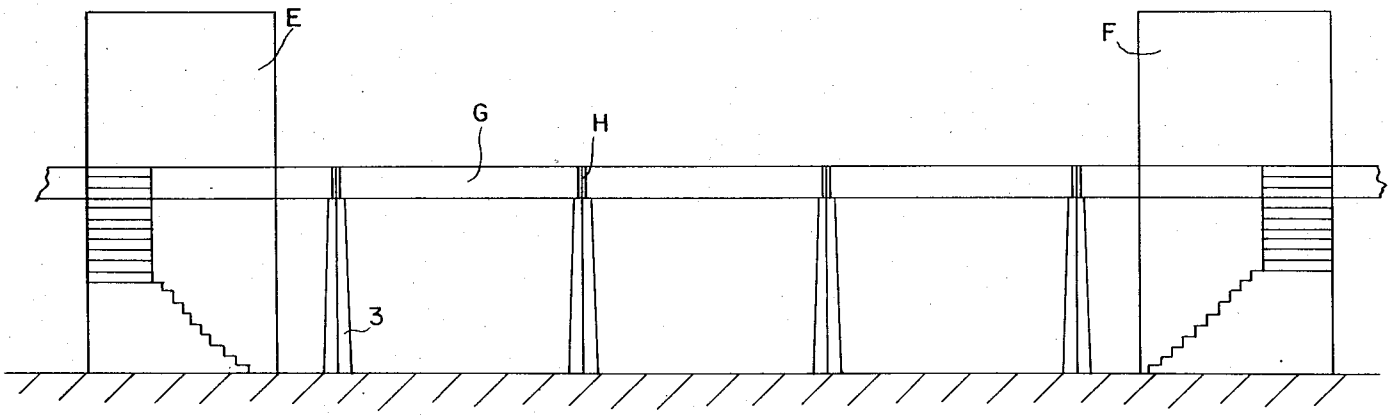
FIG. 1A is a lateral side elevation for the trackway of the transportation system.

In FIG. 1A there is represented a lateral view of a typical stretch (EF) of the trackway of the pneumatic propulsion system object of this invention, having two terminals (E) and (F) for access of passengers and/or freight that are linked by a succession of beams (G) similar to those described in FIG. 1, supported on pillars (3) disposed at regular intervals, it being apparent that a single pillar may support the adjacent ends of two beams (G) and that the beam ends are sealed one against the other by elastic sealants (H).

Figure 2:
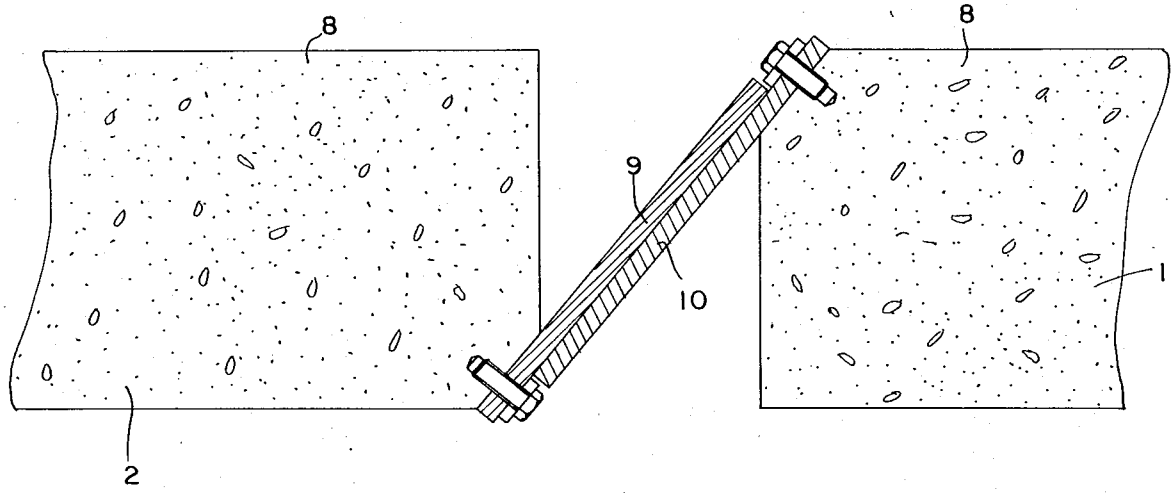
FIG. 2 is an enlarged fragmentary portion of FIG. 1 in the region of the pneumatic slit.

In FIG. 2 a detail of the beam in FIG. 1 is shown in cross-section, this being the central portion of the upper member (8) of modules (1) and (2), in order to show clearly the seal assembly of the longitudinal slit (6). On this Figure we have two flaps made of flexible material (9) and (10) that are assembled symmetrically to the edges of top member (8) of beam modules (1) and (2). Flaps (9) and (10) are superimposed and, when an air pressure differential, either positive or negative, exists between the interior of the beam and the atmosphere the two flaps will press together providing efficient sealing for the air duct made up by the interior of the beam. On the other hand, the propulsion plate support mast will slide between flaps (9) and (10) pushing them aside momentarily on its passage.

So, FIG. 2 characterizes a sealing system for slit (6) constituted by the flaps of flexible material (9) and (10) mounted symmetrically on the edges of top member (8) of beam modules (1) and (2) in a way that, whenever a pressure differential either positive or negative is established between the interior of the propulsion air duct and the atmosphere, said flaps will press together providing efficient sealing to the propulsion air duct while at the same time giving free passage to the propulsion plate support mast.

Figures 3, 3A:
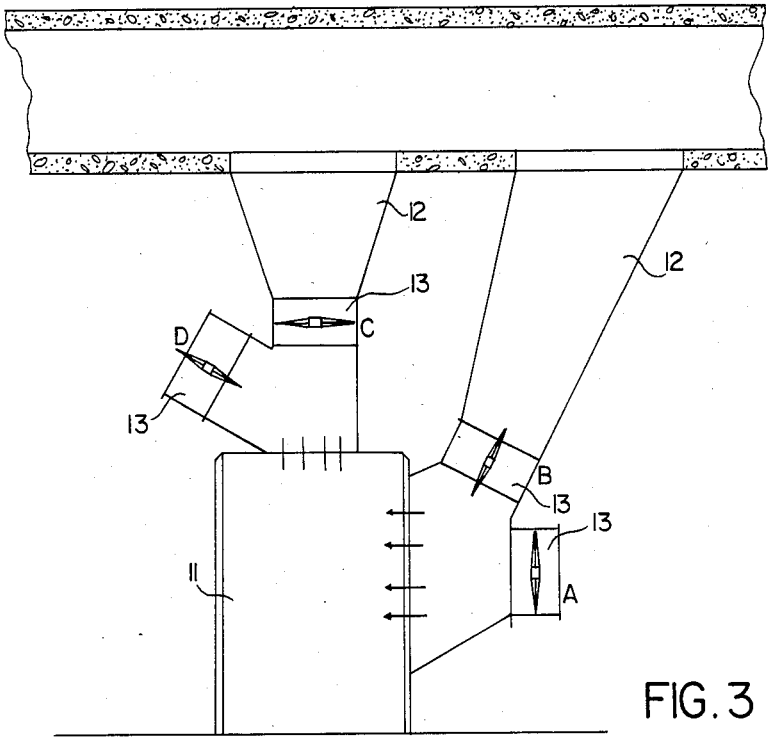
FIG. 3 is a side elevation of the elements that generate and control pneumatic propulsion in the transportation system.
FIG. 3A is a table showing the combination of control valve positions for various operating modes.

FIG. 3 shows the configuration of the equipments for generation and control of pneumatic propulsion, showing the beam whose hollow inner volume functions as the propulsion air duct, a stationary centrifugal air blower (11) or any other airflow generator providing air to the system, connection ducts (12) and a set of four butterfly airflow control valves (13). Said control valves have moving plates that can assume "all open" or "all shut" positions plus several intermediate positions. Specific combinations of these positions allow the airflow from the air generator unit to be channelled to the propulsion air duct in operating modes of "pressure" or suction (overpressure in duct with relation to the atmosphere in duct). The Table of FIG. 3A establishes what combination of positions A, B, C and D of control valves (13) is required in order to obtain operation in "Suction" or "Pressure" modes. For the "Open" position each control valve allows several angular positions of its throttle plate, which may be selected by the system operator providing for modulation of vehicle propulsion in both modes within the performance limits of the airflow generator unit (11). Attention is called to the redundancy present in the two-by-two control valve combination, which ensures total operational safety of this system. In this case of jamming of one valve's throttle plate in an "open" position, its partner provides shutdown of the air circuit, so that in any situation control over propulsion is maintained through the valve in the more closed position. So, this figure characterizes pneumatic propulsion generation and control equipment comprising an air-flow generator unit (11) connected to the main air duct by connection ducts (12) and outfitted with a set of four butterfly control valves (13) whose control from positions "open" to "closed" is effected by a control system in the way described.

Figure 4:
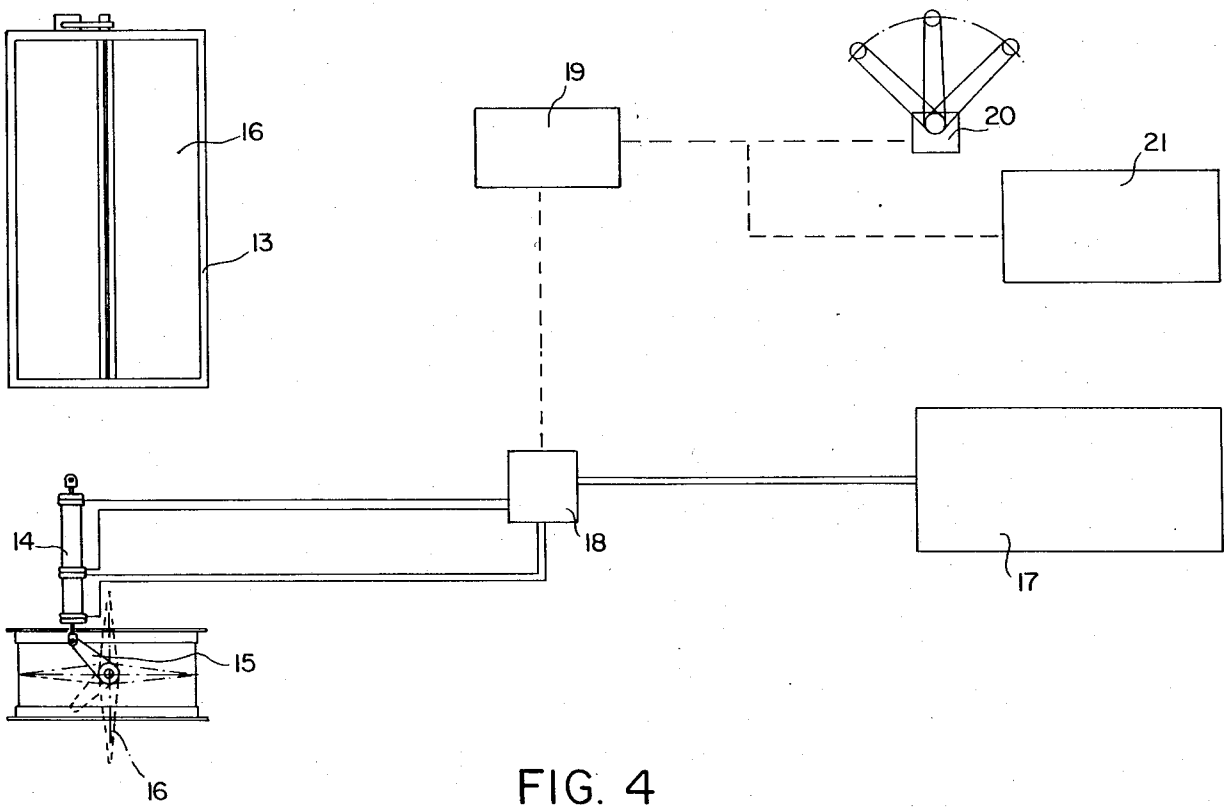
FIG. 4 is a schematic of the control system for pneumatic propulsion.

In FIG. 4 we have a detail view of the control system for the airflow control valves (13), showing a pneumatic cylinder (14) linked to the command lever (15) that rotates the valve's throttle plate (16). Air pressure for cylinder (14) is supplied by an air compressor (17) and controlled by an electropneumatic valve (18). An electronic miodule of logic circuits (20) selects the proper position of each of the four control valves in accordance with the desred operating mode. The operator has control of the system through lever (19). He may select "pressure" or "suction" modes to establish direction of vehicle motion. At the same time he may graduate the amount of propulsive traction that is applied.

In case of automatic operation of the system, the logic circuits (19) will be controlled by the output module (21) of a control microprocessor. So, this figure shown characterizes the control system of the airflow control valves (13) comprising a pneumatic cylinder (14) linked to a lever (15) that moves the valve's throttle plate (16) this cylinder being controlled by an electropneumatic valve (18) tied to an air compressor (17) said valve being actuated by an electric selector switch (20) in conjunction with an electronic module of logic circuits (19) which, in case of automatic operation of the system is controlled by the output module (21) of a control microprocessor. Refering to the logic circuit electronic module (19) it is pointed out that it sets valves (13) in positions two-by-two to establish the desired airflow and pressure, providing operation of the transportation system in the full range of speeds and vehicle accelerations in both directions of motion through one single control lever (20), the layout of the control valves being such that in case of failure of any one valve, another will ensure control over the propulsion airflow, guaranteeing total operating safety.

Figure 5:
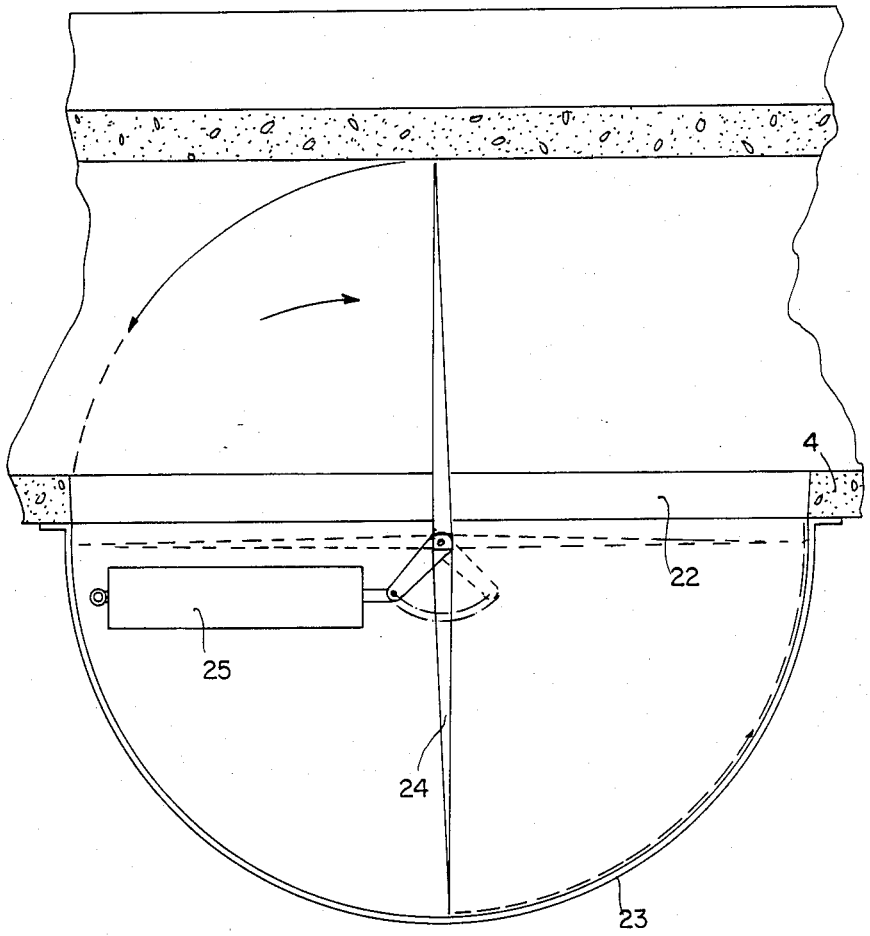
FIG. 5 is a fragmentary longitudinal cross-section illustrating an air duct shut down valve mounted to a beam of the transportation system.

In FIG. 5 we have shown the installation of an air duct shutdown valve, showing the beam described in FIG. 1 in longitudinal section.

Figure 6:
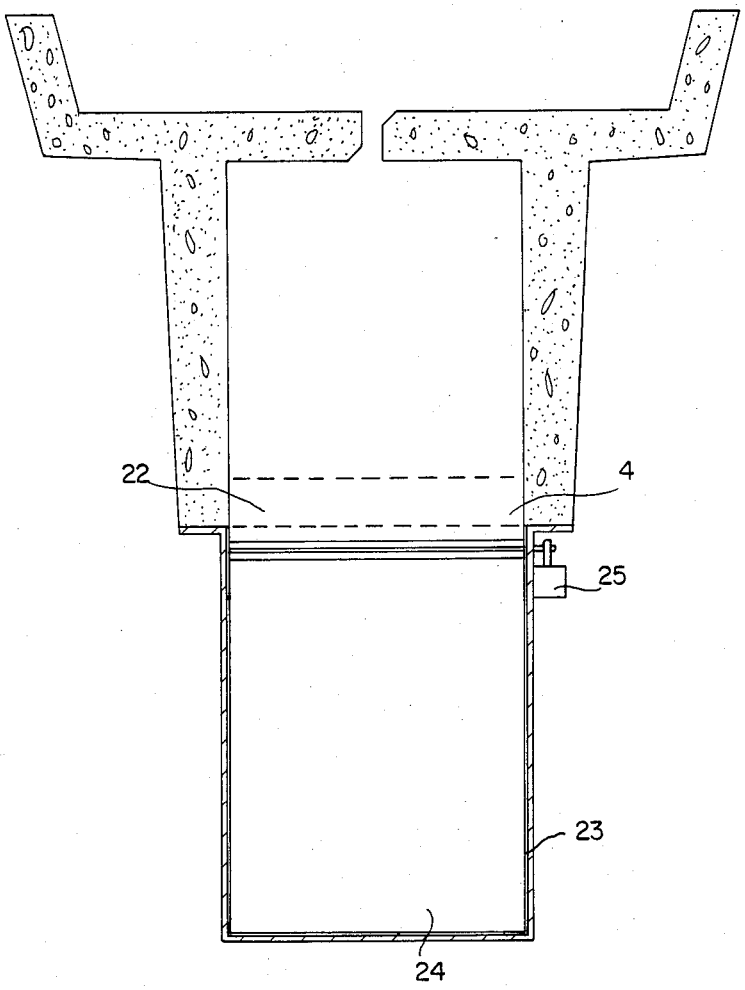
FIG. 6 is a front elevation of the elements illustrated in FIG. 5.

In FIG. 6 we have a frontal view of FIG. 5, showing the same elements. We see an opening (22) on the bottom of the beam which purpose it is to receive air connecting ducts (12) or the body (23) of the shutdown valve, which comprises a throttle plate (24) actuated by a pneumatic cylinder (25), said plate taking up a fully closed or a fully open position with respect to the air duct. By its design, this valve has minimum actuation efforts, since it is balanced with relation to the air pressure acting on it. So, the two last Figures characterize a shutoff valve that is installed in openings (22) of bottom module (4) having a throttle plate (24) that rotates in body (23) by action of cylinder (25) to block or leave open the air duct, said throttle plate being pressure-balanced.

Figure 7:
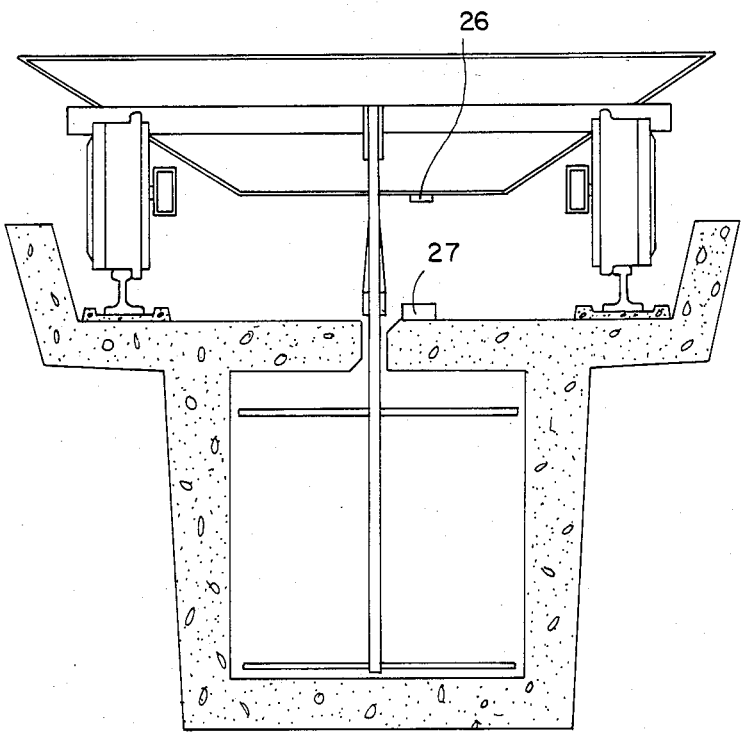
FIGS. 7 and 8 are front and plan views, respectively, of the suspension for a vehicle of the transportation system.
Figure 8:
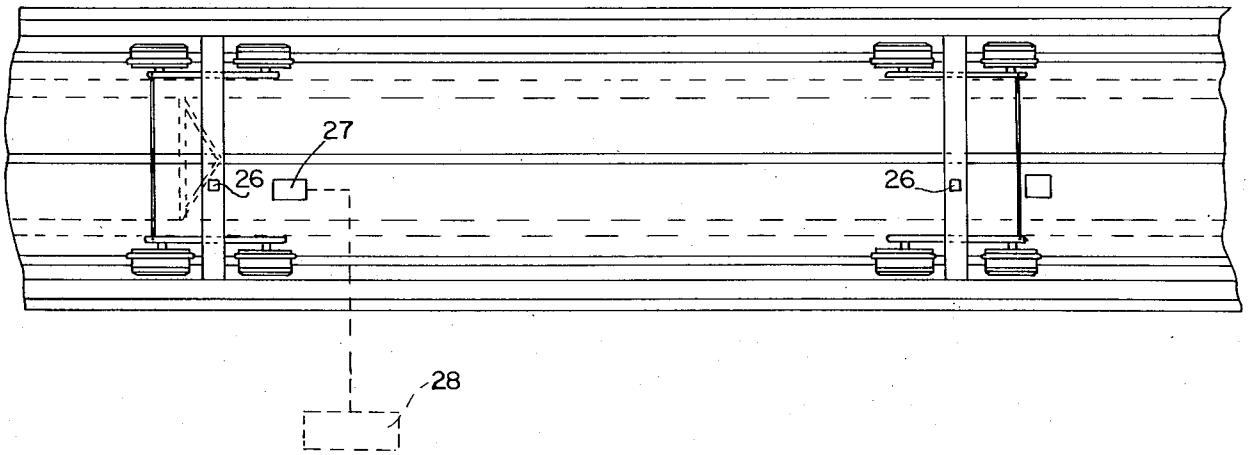

In FIGS. 7 and 8 we have a frontal and plan view of the structure and wheels of the vehicle, to illustrate how position and speed of the vehicle are determined as it travels along the trackway, providing the operator and/or a control mircroprocessor with continuous information on these parameters. Thus, permanent magnets (26) are attached to the vehicle at two points aligned in the longitudinal direction, while "reed" type magnetic sensors (27) or other electromagnetic detection devices are spaced regularly along the trackway in the same plane as devices (26) on vehicle. Passage of the first device (26) over sensor (27) will trigger an electric pulse that is interpreted by a centrally located electronic unit (28) in terms of vehicle position. Time between passage of the first and second magnet (26) is used by unit (28) to compute speed of vehicle at passage over sensor (27). From this information, other parameters of performance may be computed.

Figure 9:
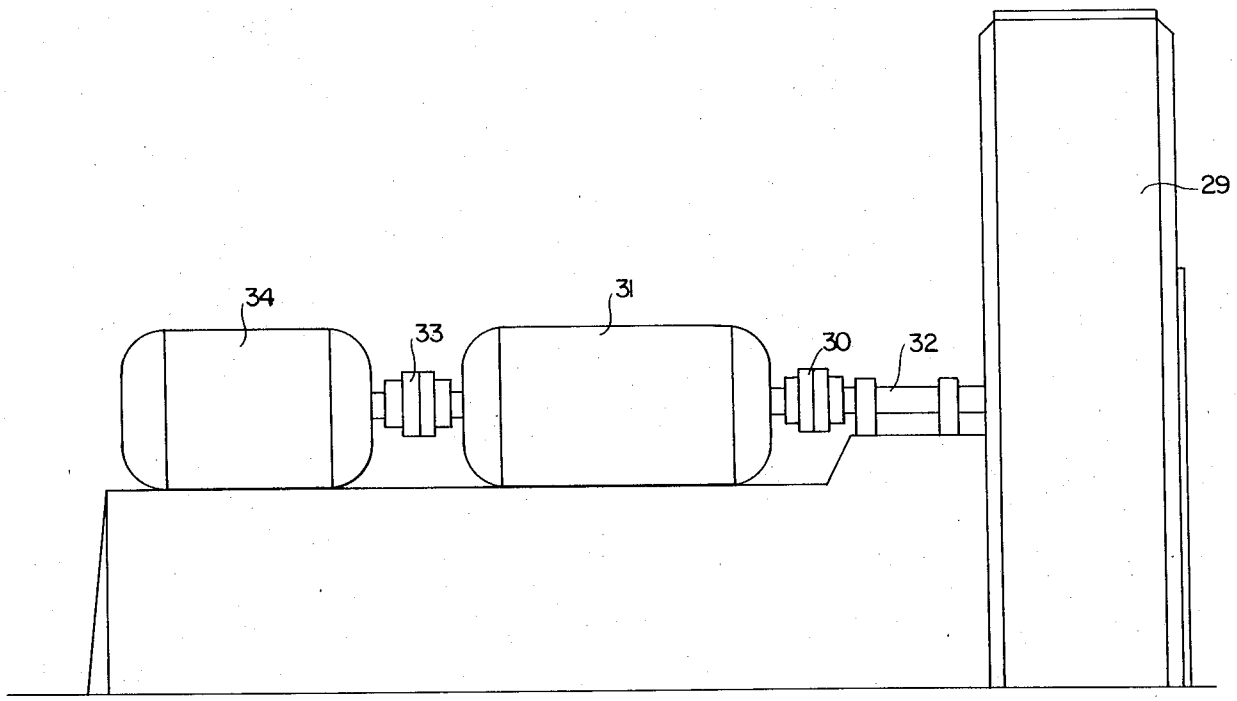
FIG. 9 is a side elevation of the system that provides air for pneumatic propulsion in the transportation system.

FIG. 9 depicts an air blower with its motor, that provides air for pneumatic propulsion of the transportation system of this invention. A centrifugal blower (29) or any other airflow generator unit is moved by an electric motor (31) through shaft (32) and coupling (30). A second motor (34) is connected to the electric motor (31) through coupling (33), the airflow generator (29) may be actuated by either motor. When motor (34) is actuated, motor (31) will be de-energized behaving like a passive transmission element. In the opposite case, motor (34) will be passively dragged. This arrangement provides operation of the air blower at two speeds, and further provides redundancy, since in case of failure of one motor the other may take over.

Figure 10:
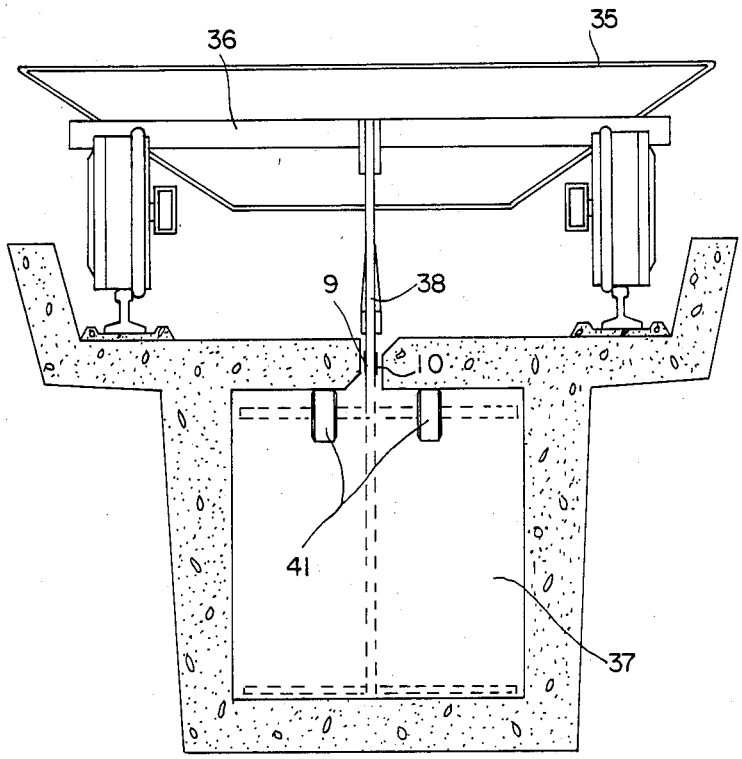
FIGS. 10 and 11 are front and side elevations, respectively, of the vehicle undercarriage and trackway.
Figure 11:
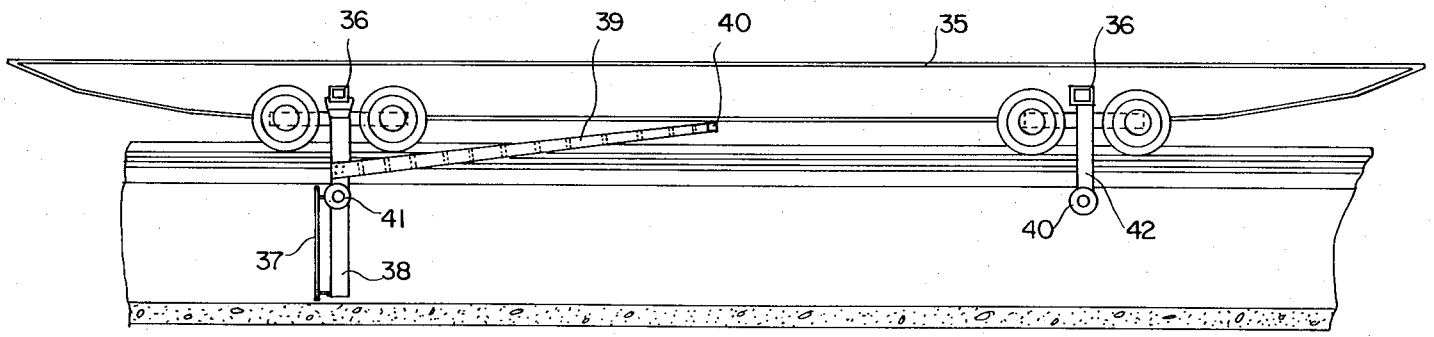

FIGS. 10 and 11 depict the undercarriage of the vehicle on the trackway, showing the safety device against derailment adopted by this transportation system. In detail we see the vehicle's base structure (35) and the cross beams (36) on which it is supported. The propulsion plate (37) is connected to the cross beam (36) by the support mast (38) and directly to the vehicle structure by a traction arm (39) and swivel joint (40). It is pointed out that the propulsion plate (37) is located behind the mast (38). Consequently the mast (38) goes through the sealing flaps (9) and (10) in the depressurized area of the propulsion duct, where these seals are no longer subject to differential pressure. Therefore the passage of mast (38) requires less parting effort of the flaps and loss of pressure is minimized. A pair of retainer wheels (41) checks vertical movements of the vehicle, bearing against the top inner surface (8) of the beam thus avoiding loss of contact between wheels and rails. This safety service is applicable to any vehicle travelling on rails over an elevated trackway, as shown in these Figures, where a set of wheels not outfitted with a propulsion plate is shows having a mast (42) on which retainer wheels (41) are mounted connecting to the vehicle crossbeam (36), the assembly having the safety function against derailment described above.

Figure 12:
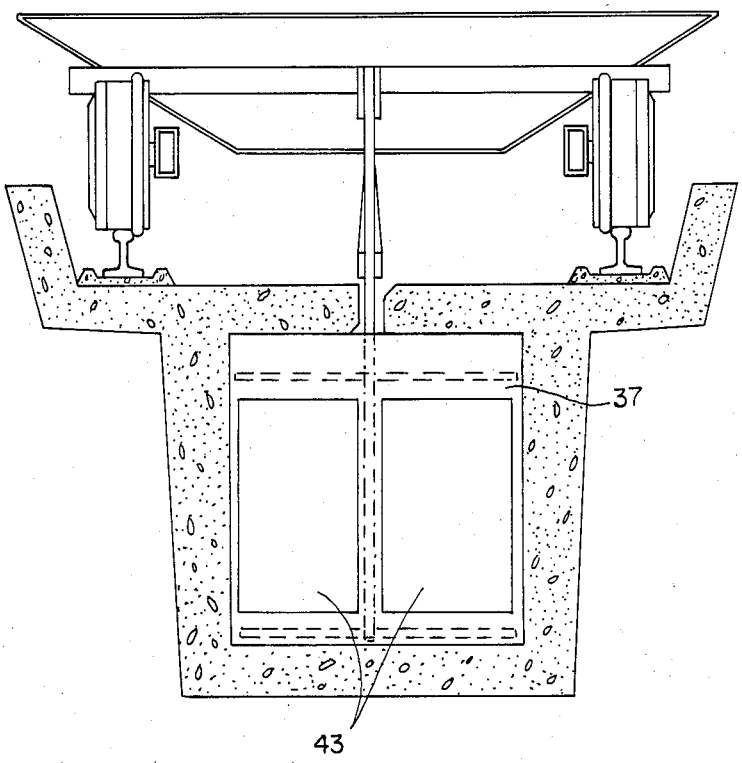
FIG. 12 is a front elevation of the elements that protect the transportation system against excessive surges of differential pressure.
Figure 13:
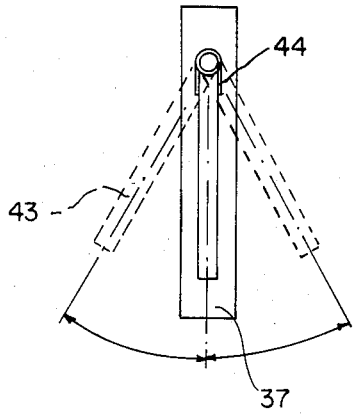
FIG. 13 is a side elevation of a decompression channel illustrated in FIG. 12.

FIGS. 12 and 13 depict the decompression panels (43) installed on the propulsion plate (37) to protect the system against differential pressure surges that might exceed a safety thereshold. Panels (43) are tightly shut by adjustable springs (44). When the differential pressure acting on the propulsion plate (37) exceeds a present value, the resultant thrust overcomes springs (44) pushing panels (43) open permitting air to flow through the openings in the plate, thus equalizing the air pressure differential on same. The air duct structure and the propulsion plate itself are effectively protected against the effect of overpressures.

Figure 14:
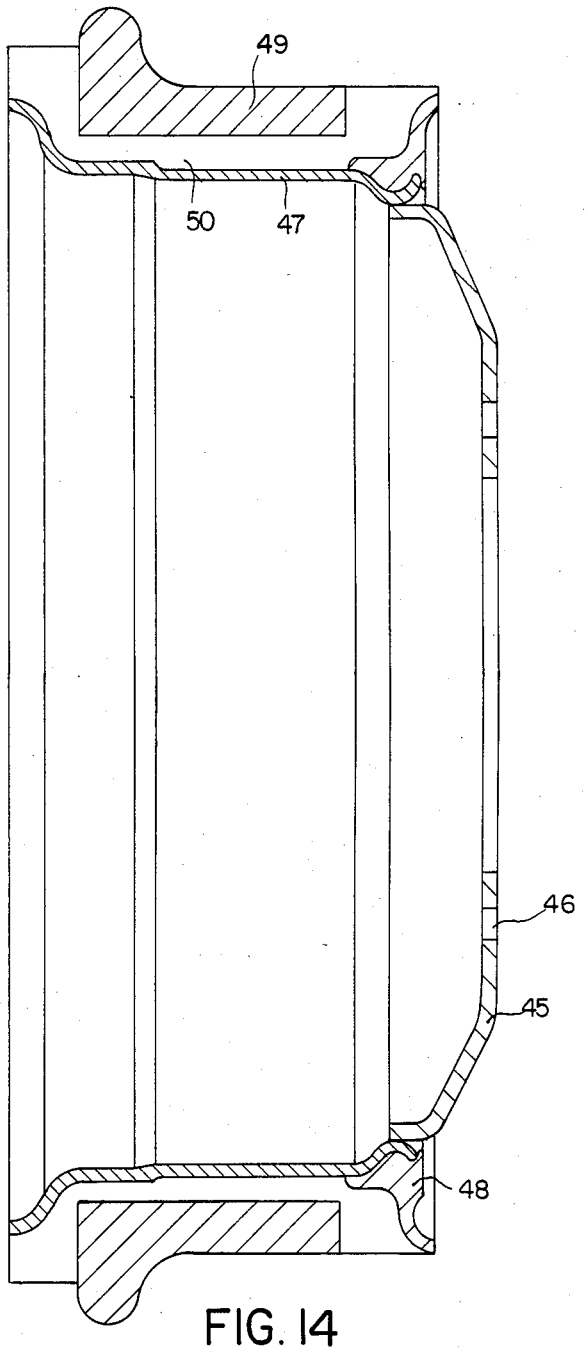
FIG. 14 is a cross-section of a wheel taken through a diameter thereof.

FIG. 14 depicts a cross section of a vehicle wheel. Structure of wheel (45) has a configuration similar to that of road vehicles, having holes (46) for assembly to a wheel hub, an external flange (47) and retainer ring (48). An outer rim (49) cast in steel, has a profile compatible with the rolling on rails, said rim (49) being embedded in a layer of rubber (50) or other high-hardness elastomer that connects with the external flange (47) and retainer ring (48). In the manufacturing process, wheel structure (45) is assembled from structures elements (45) (47) and (48) and, with outer rim (49) positioned in a mold, the elastomer layer (50) is cast between these elements, said layer being cured in the mold, thus establishing a high-strength elastic connection that ensures good properties of vibration and noise absorption from the wheel/rail contact.

Figure 15:
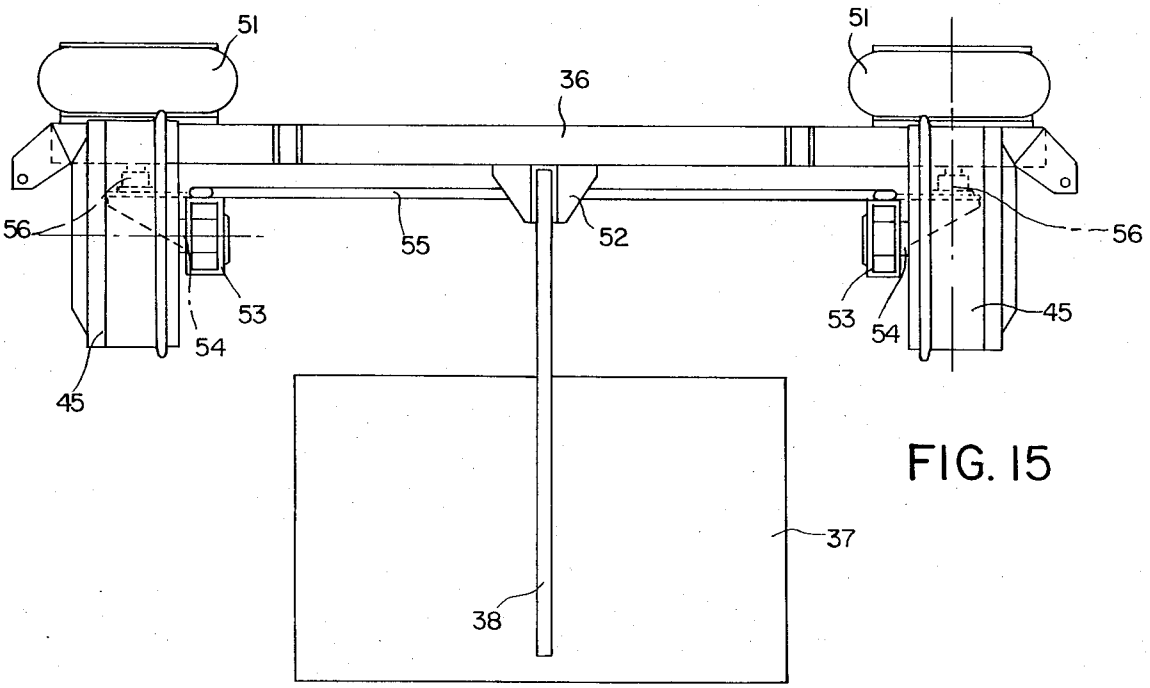
FIGS. 15, 16 and 17 are end, plan and side views, respectively, of the independent dual-wheel system for a vehicle of the transportation system.
Figure 16:
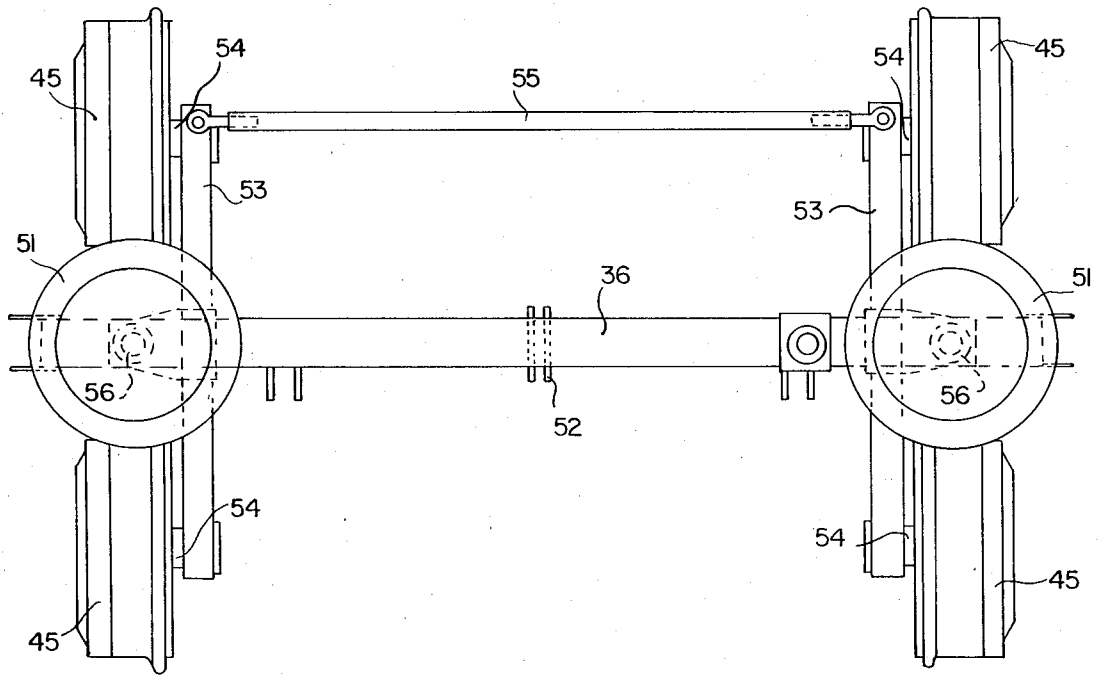
Figure 17:
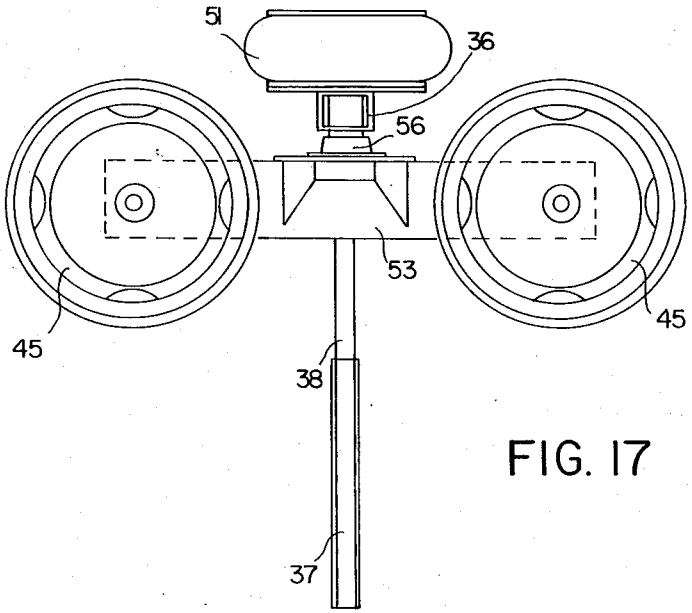

FIGS. 15, 16 and 17 depict the independent dual-wheel system fitted to the vehicle. Air bags (51) are assembled to the crossbeams (36) to support the vehicle's main structure, isolating it from shocks and vibrations coming from wheels (45). Crossbeam (36) also contains the structure (52) of attachment of the support mast (38). Longitudinal beams (53) are swivelled at their center through thrust bearings (56), having at both ends axles (54) onto which wheel assemblies (45) are mounted. A tie bar (55) may be used to adjust parallelism or convergence angle between beams (53). It may be seen that the wheels that roll on one rail have no connection with the wheels on the symmetrical rail. Also, all wheels spin freely without any constraint from traction drives, a unique feature of this system.

Figure 18:
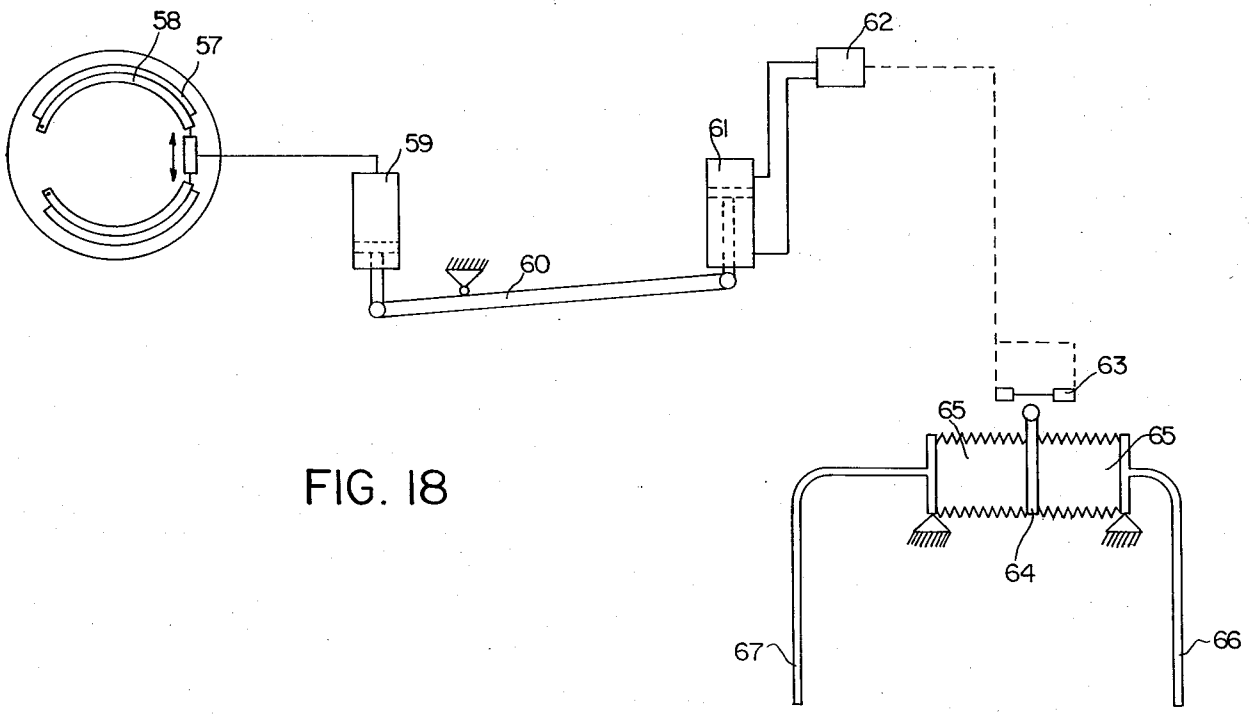
FIG. 18 is a schematic of the hydraulic brake system for a vehicle of the transportation system.

FIG. 18 is a schematic of the brake hydraulic system, consisting basically of a differential pressure sensor that commands the brakes whenever the pressure differential across the propulsion plate (37) drops close to zero. The system comprises brake drums (57) inside which brake pads (58) are hydraulically actuated by cylinders (59). Hydraulic pressure is metered by actuation of a lever system by means of a pneumatic cylinder controlled by an electro-pneumatic valve (62). Said valve is electrically actuated by microswitches (63) that are actuated by the displacement of diaphragm (64) that partitions bellows chambers (65) connected to pressure probes (66) and (67) installed respectively in front of and behind propulsion plate (37).

When a pressure differential is established over propulsion plate (37) a resultant force propels the vehicle. This differential is sensed in bellows (65) producing the displacement of diaphragm (64). By its displacement, the diaphragm actuates one of the microswitches (63) closing the electric circuit of valve (62) thereby actuating pneumatic cylinder (61) to release the brakes (57,58). In the absence of a pressure differential across plate (37) pressure in bellows chambers (65) will equalize, diaphragm (64) will centralize remaining out of contact with microswitches (63), thus closing an electric circuit that will actuate pneumatic cylinder (61) to set the brakes. It may be added that, if it is desired to apply brakes in conjunction with deceleration by air thrust, a sense-of-rotation sensor may deactivate microswitch (63) that in this case will be depressed.

Figure 19:
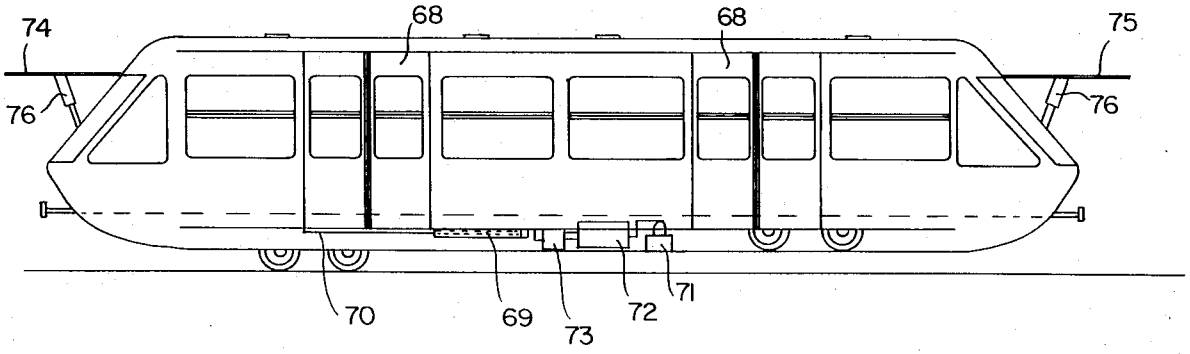
FIG. 19 is a side elevation of a vehicle for the transportation system.

FIG. 19 is a lateral view of the vehicle, showing its doors with the respective actuating mechanism, and the emergency doors. Lateral doors (68) are actuated by means of pneumatic cylinders (69), the two sides of each door being synchronized by a system of cables and pulleys (70). Compressed air for cylinders (69) is furnished by dual electropneumatic compressors (72). Control is effected by electropneumatic valves (73) that receive signals from an electronic door control unit or, alternatively, from a manual door selector switch. Frontal windows (74) and (75) may be manually opened staying in the open position by means of hydraulic cylinders (76) providing access of passengers to the trackway for the case of emergency evacuation.

Figure 20:
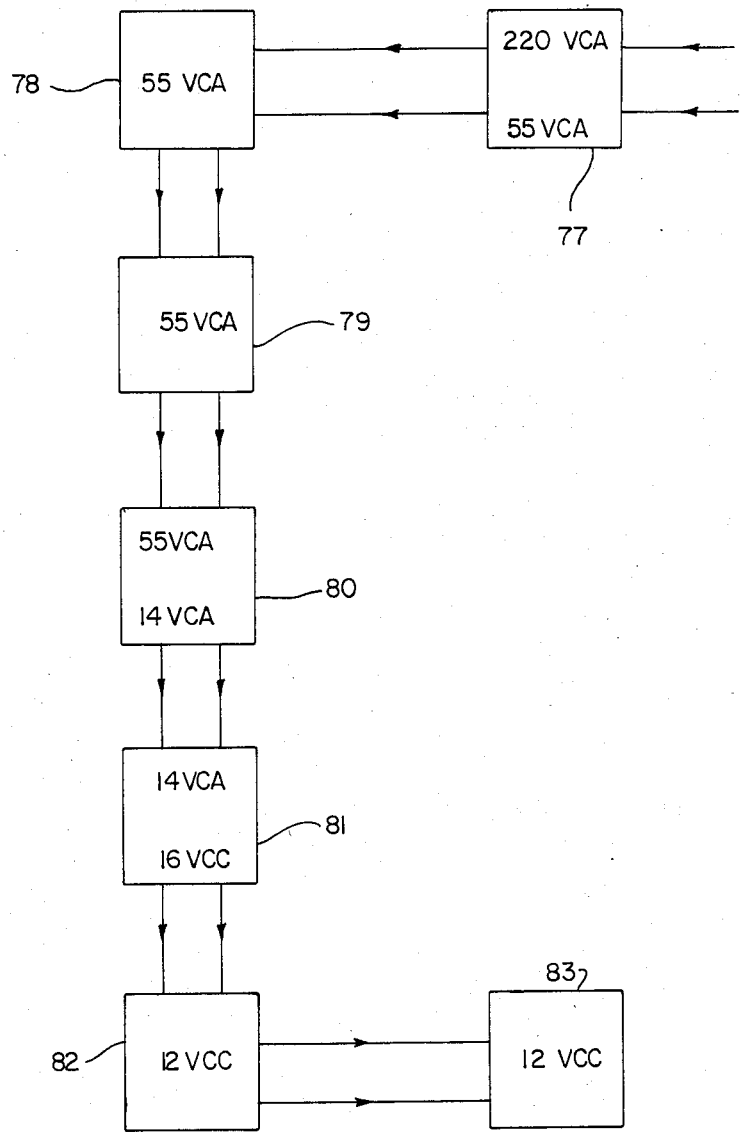
FIG. 20 is a block diagram of the electrical supply system for a vehicle of the transportation system.

FIG. 20 shows a block diagram of the electric supply system for the vehicle. Transformer (77) located adjacent to the trackway receives public network electricity which it feeds at 55 V to the rails. The purpose of this very low tension is to render the rails, although electrified, harmless to humans, considering the use of the trackway as an evacuation path of passengers. Block (78) represents the rails, which are useable as electric conductors due to their insulation with respect to the beam. Carbon brushes (79) on the vehicle collect electric power from the wheels feeding the vehicle's transformers (80) and rectifiers (81) that feed the on-board batteries (83) with AC current by way of a charging and regulating module (82).

What is claimed is:

1. Improvements in a transportation system for pneumatic propulsion of passenger and/or freight vehicles, said transportation system being characterized by including:

beams connected in tandem and constructed of prefabricated modules, pillars providing end supports for said beams, a trackway supported on said beams;

said beams defining a longitudinal propulsion air duct having a longitudinal slit at the top thereof, an openable sealing system for closing said slit;

a vehicle supported on said trackway, a propulsion plate within said duct, a mast extending through said sealing system, a traction arm and said mast connecting said vehicle to said propulsion plate, lateral doors on said vehicle for normal entry and exit, frontal windows on said vehicle that are widely operable for emergency exit;

an on-board battery means for said vehicle, an electrification means for energizing said transportation system, said electrification means supplying electrical energy through said trackway to said battery means;

a braking system for said vehicle, pressure sensing means for controlling actuation of said braking system in response to differential pressures within said duct;

a stationary airflow generator for supplying said duct with pneumatic propulsion air under pressure, a set of valves for regulating said propulsion air, control module means for controlling said set of valves;

sensing means for positioning said vehicle along said trackway and for controlling speed of said vehicle;

a retainer wheel means connected to said vehicle and moving within said duct to prevent derailing of said vehicle;

a plurality of wheel assemblies connected to said vehicle, each of said assemblies including four non-driven rotatable wheels, each of said wheels including a rim, a hub inside of said rim and a vibration absorbing layer between said rim and said hub;

movable decompression panel means for said propulsion plate to protect said transportation system from being damaged as a result of excessive pressure differentials on opposite sides of said propulsion plate;

said decompression panel means (43) being adjustable as to the differential pressure to move from a shut position wherein through aperture means of said propulsion plate is blocked, to an open position wherein said aperture means is clear; and spring means (44) biasing said propulsion plate (37) toward said shut position; said propulsion plate (39) moving to said open position automatically in the event differential air pressure exceeds a limit value set for structural protection of the system.

2. Improvements in a transportation system for pneumatic propulsion of passenger and/or freight vehicles as claimed in claim 1, further characterized by comprising hoop reinforcements (5) at both ends of each of the beams.

3. Improvements in a transportation system for pneumatic propulsion of passenger and/or freight vehicles as claimed in claim 1, further characterized by openings (22) in the bottom of the beams and including air shutoff valves fitted to said openings; said air shutoff valves including a body (23) and throttle plates (24) swivel-mounted in said body (23); and pneumatic actuator cylinders (26) for actuating said air shutoff valves to leave the propulsion air duct free or block same.

4. Improvements in a transportation system for pneumatic propulsion of passenger and/or freight vehicles as claimed in claim 1, further characterized by having said retainer wheel means travel on the inside of the duct and bearing against the inside of the beam at the top thereof in the event of vertical movement of the wheels of the assemblies.

5. Improvements in a pneumatic propulsion system for passenger and/or freight vehicles as claimed in claim 1, further characterized by structural wheel assemblies comprising two longitudinal beams (53) that swivel centrally on thrust bearings (56) upon the crossbeam (36) said crossbeam supporting elastic air bags (51) for vehicle support, said beams (53) being fitted with tie-bars (55) to adjust parallelism or a convergence angle and having at each end an axle (54) on which wheels (45) are assembled.

6. Improvements in a transportation system for pneumatic propulsion of passenger and/or freight vehicles as claimed in claim 1, further characterized by having said sealing system for the longitudinal slit (6) on the beam including first and second flexible material flaps (9) and (10) mounted symmetrically at opposite sides of said slit to a first and a second of said modules (1) and (2), respectively, in such a way that, as a differential pressure either negative or positive is established between the duct and atmosphere, the flaps will further press one against the other, effectively sealing off the duct.

7. Improvements in a transportation system for pneumatic propulsion of passenger and/or freight vehicles as claimed in claim 6, further characterized by having each of said flaps include a longitudinally extending free edge; said first flap being upwardly inclined towards its said free edge and said second flap being downwardly inclined toward its said free edge; said free edges normally engaging one another to close said slit.

8. Improvements in a transportation system for pneumatic propulsion of passenger and/or freight vehicles as claimed in claim 1, further characterized by having a set of connection ducts interposed between the stationary airflow generator to the propulsion air duct, a valve command and control system including said control module means; said set of valves comprising four air control valves (13) the control of which for the "open" and "closed" position is effected by said valve command and control systems; each of said valves including a throttle plate (16); said improvements in a pneumatic propulsion system for passengers comprising a lever (15) and a pneumatic cylinder (14) connected to said lever (15) for actuating said throttle plate (16) of said valve; an electropneumatic valve (18) for controlling said cylinder; an air compressor (17) feeding said electropneumatic valve (18); an electric selector switch (20) for switching said another valve (18); an electronic module of logic circuits (19) operating in conjunction with selector switch (20); said module being under control of the control microprocessor having an output module (21) for controlling said electronic module to affect automatic system operation.

9. Improvements in a transportation system for pneumatic propulsion of passenger and/or freight vehicles as claimed in claim 8, further characterized by openings (22) in the bottom of the beams and including air shutoff valves fitted to said openings; said air shutoff valves including a body (23) and throttle plates (24) swivel-mounted in said body (23); and pneumatic actuator cylinders (26) for actuating said air shutoff valves to leave the propulsion air duct free or block same.

10. Improvements in a transportation system for pneumatic propulsion of passenger and/or freight vehicles as claimed in claim 1, further characterized by providing the vehicle with a crossbeam (36) and a frame supported by said crossbeam; a swivel joint (40) and said traction arm (39) connecting said propulsion plate (37) to said frame; said mast (38) connecting said propulsion plate to said crossbeam; said propulsion plate (37) being located behind said mast (38).

11. Improvements in a transportation system for pneumatic propulsion of passenger and/or freight vehicles as claimed in claim 10, further characterized by having said retainer wheel means travel on the inside of the duct and bearing against the inside of the beam at the top thereof in the event of vertical movement of the wheels of the assemblies.

12. Improvements in a pneumatic propulsion system for passenger and/or air freight vehicles as claimed in claim 10, further characterized by structural wheel assemblies comprising two longitudinal beams (53) that swivel centrally on thrust bearings (56) upon the crossbeam (36) said crossbeam supporting elastic air bags (51) for vehicle support, said beams (53) being fitted with tie-bars (55) to adjust parallelism or a convergence angle and having at each end an axle (54) on which wheels (45) are assembled.

13. Improvements in a transportation system for pneumatic propulsion of passenger and/or freight vehicles, said transportation system being characterized by including:

beams connected in tandem and constructed of prefabricated modules, pillars providing end supports for said beams, a trackway supported on said beams;

said beams defining a longitudinal propulsion air duct having a longitudinal slit at the top thereof, an openable sealing system for closing said slit;

a vehicle supported on said trackway, a propulsion plate within said duct, a mast extending through said sealing system, a traction arm and said mast connecting said vehicle to said propulsion plate, lateral doors on said vehicle for normal entry and exit, frontal windows on said vehicle that are widely operable for emergency exit;

an on-board battery means for said vehicle, an electrification means for energizing said transportation system, said electrification means supplying electrical energy through said trackway to said battery means;

a braking system for said vehicle, pressure sensing means for controlling actuation of said braking system in response to differential pressures within said duct;

a stationary airflow generator for supplying said duct with pneumatic propulsion air under pressure, a set of valves for regulating said propulsion air, control module means for controlling said set of valves;

sensing means for positioning said vehicle along said trackway and for controlling speed of said vehicle;

a retainer wheel means connected to said vehicle and moving within said duct to prevent derailing of said vehicle;

a plurality of wheel assemblies connected to said vehicle, each of said assemblies including four non-driven rotatable wheels, each of said wheels including a rim, a hub inside of said rim and a vibration absorbing layer between said rim and said hub;

movable decompression panel means for said propulsion plate to protect said transportation system from being damaged as a result of excessive pressure differentials on opposite sides of said propulsion plate;

said sealing system for the longitudinal slit (60) on the beam including first and second flexible material flaps (9) and (10) mounted symmetrically at opposite sides of said slit to a first and a second of said modules (1) and (2), respectively, in such a way that, as a differential pressure either negative or positive is established between the duct and atmosphere, the flaps will press one against the other, effectively sealing off the duct;

each of said flaps including a longitudinally extending free edge with said first flap being upwardly inclined towards its said free edge, said second flap being downwardly inclined toward its said free edge and said free edges normally engaging one another to close said slit.

14. Improvements in a pneumatic propulsion system for passenger and/or air freight vehicles as claimed in claim 13, further characterized by structural wheel assemblies comprising two longitudinal beams (53) that swivel centrally on thrust bearings (56) upon the crossbeam (36) said crossbeam supporting elastic air bags (51) for vehicle support, said beams (53) being fitted with tie-bars (55) to adjust parallelism or a convergence angle and having at each end an axle (54) on which wheels (45) are assembled.

15. Improvements in a transportation system for pneumatic propulsion of passenger and/or freight vehicles as claimed in claim 13, further characterized by having a set of connection ducts interposed between the stationary airflow generator to the propulsion air duct, a valve command and control system including said control module means; said set of valves comprising four air control valves (13) the control of which for the "open" and "closed" position is effected by said valve command and control systems; each of said valves including a throttle plate (16); said improvements in a pneumatic propulsion system for passengers comprising a lever (15) and a pneumatic cylinder (14) connected to said lever (15) for actuating said throttle plate (16) of said valve; an electropneumatic valve (18) for controlling said cylinder; an air compressor (17) feeding said electropneumatic valve (18); an electric selector switch (20) for switching said another valve (18); an electric module of logic circuits (19) operating in conjunction with selector switch (20); said module being under control of the control microprocessor having an output module (21) for controlling said electronic module to affect automatic system operation.

16. Improvements in a transportation system for pneumatic propulsion of passenger and/or freight vehicles as claimed in claim 15, further characterized by openings (22) in the bottom of the beams and including air shutoff valves fitted to said openings; said air shutoff valves including a body (23) and throttle plates (24) swivel-mounted in said body (23); and pneumatic actuator cylinders (26) for actuating said air shutoff valves to leave the propulsion air duct free or block same.

17. Improvements in a transportation system for pneumatic propulsion of passenger and/or freight vehicles as claimed in claim 16, further characterized by having the decompression panel means (43) adjustable as to the differential pressure to move from a shut position wherein through aperture means of said propulsion plate is blocked, to an open position wherein said aperture means is clear; spring means (44) biasing said propulsion plate (37) toward said shut position; said propulsion plate (39) moving to said open position automatically in the event differential air pressure exceeds a limit value set for structural protection of the system.

18. Improvements in a transportation system for pneumatic propulsion of passenger and/or freight vehicles, said transportation system being characterized by including:

beams connected in tandem and constructed of prefabricated modules, pillars providing end supports for said beams, a trackway supported on said beams;

said beams defining a longitudinal propulsion air duct having a longitudinal slit at the top thereof, an openable sealing system for closing said slit;

a vehicle supported on said trackway, a propulsion plate within said duct, a mast extending through said sealing system, a traction arm and said mast connecting said vehicle to said propulsion plate, lateral doors on said vehicle for normal entry and exit, frontal windows on said vehicle that are widely operable for emergency exit;

an on-board battery means for said vehicle, an electrification means for energizing said transportation system, said electrification means supplying electrical energy through said trackway to said battery means;

a braking system for said vehicle, pressure sensing means for controlling actuation of said braking system in response to differential pressures within said duct;

a stationary airflow generator for supplying said duct with pneumatic propulsion air under pressure, a set of valves for regulating said propulsion air, control module means for controlling said set of valves;

sensing means for positioning said vehicle along said trackway and for controlling speed of said vehicle;

a retainer wheel means connected to said vehicle and moving within said duct to prevent derailing of said vehicle;

a plurality of wheel assemblies connected to said vehicle, each of said assemblies including four non-driven rotatable wheels, each of said wheels including a rim, a hub inside of said rim and a vibration absorbing layer between said rim and said hub;

movable decompression panel means for said propulsion plate to protect said transportation system from being damaged as a result of excessive pressure differentials on opposite sides of said propulsion plate;

a set of connection ducts interposed between the stationary airflow generator to the propulsion air duct, and a valve command and control system including said control module means;

said set of valves comprising four air control valves (13) the control of which for the "open" and "closed" position is effected by said valve command and control systems; each of said valves including a throttle plate (16);

said improvements in a pneumatic propulsion system for passengers comprising a lever (15) and a pneumatic cylinder (14) connected to said lever (15) for actuating said throttle plate (16) of said valve; an electropneumatic valve (18) for controlling said cylinder; an air compressor (17) feeding said electropneumatic valve (18);

an electric selector switch (20) for switching said another valve (18); an electronic module of logic circuits (19) operating in conjunction with selector switch (20);

said module being under control of the control microprocessor having an output module (21) for controlling said electronic module to affect automatic system operation.

19. Improvements in a pneumatic propulsion system for passenger and/or air freight vehicles as claimed in claim 18, further characterized by structural wheel assemblies comprising two longitudinal beams (53) that swivel centrally on thrust bearings (56) upon the crossbeam (36) said crossbeam supporting elastic air bags (51) for vehicle support, said beams (53) being fitted with tie-bars (55) to adjust parallelism or a convergence angle and having at each end an axle (54) on which wheels (45) are assembled.

* * * * *